United States Patent [19]

Moody, Jr. et al.

[11] 4,076,461

[45] Feb. 28, 1978

[54] FEEDBACK CONTROL SYSTEM FOR HELICAL SCREW ROTARY COMPRESSORS

[75] Inventors: Harold W. Moody, Jr., Farmington; Clifford T. Bulkley, Glastonbury; Joseph A. L. N. Gagnon, Windsor Locks, all of Conn.; Grover Fraser, Painted Post, N.Y.

[73] Assignee: Dunham-Bush, Inc., West Hartford, Conn.

[21] Appl. No.: 531,121

[22] Filed: Dec. 9, 1974

[51] Int. Cl.[2] ..... F04B 49/00

[52] U.S. Cl. ..... 417/310

[58] Field of Search ..... 417/307, 308, 310, 311; 418/201

[56] References Cited

U.S. PATENT DOCUMENTS

| | | | |
|---|---|---|---|
| 3,167,020 | 1/1965 | Rhode | 417/308 |
| 3,432,089 | 3/1969 | Schibbye | 418/201 |
| 3,574,474 | 4/1971 | Lukacs | 417/307 |
| 3,636,973 | 1/1972 | Roeske | 137/488 |
| 3,738,780 | 6/1973 | Edstrom | 417/310 |

*Primary Examiner*—Carlton R. Croyle
*Assistant Examiner*—Thomas I. Ross
*Attorney, Agent, or Firm*—Sughrue, Rothwell, Mion, Zinn and Macpeak

[57] ABSTRACT

An air motor, responsive to change in pressure of a compressed air supply line acts to control the flow of hydraulic motive fluid to a hydraulic motor which drives the capacity control slide valve of a helical screw, rotary compressor feeding the supply line. To eliminate hunting of the slide valve which shifts in response to change in compressor load, a mechanical feedback from the hydraulic motor modulates the flow of motive fluid to the hydraulic motor.

18 Claims, 4 Drawing Figures

FIG. 1
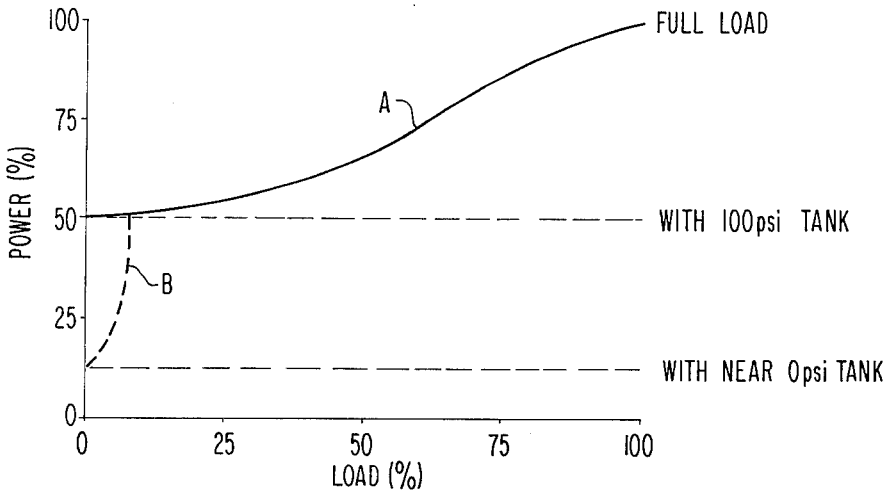
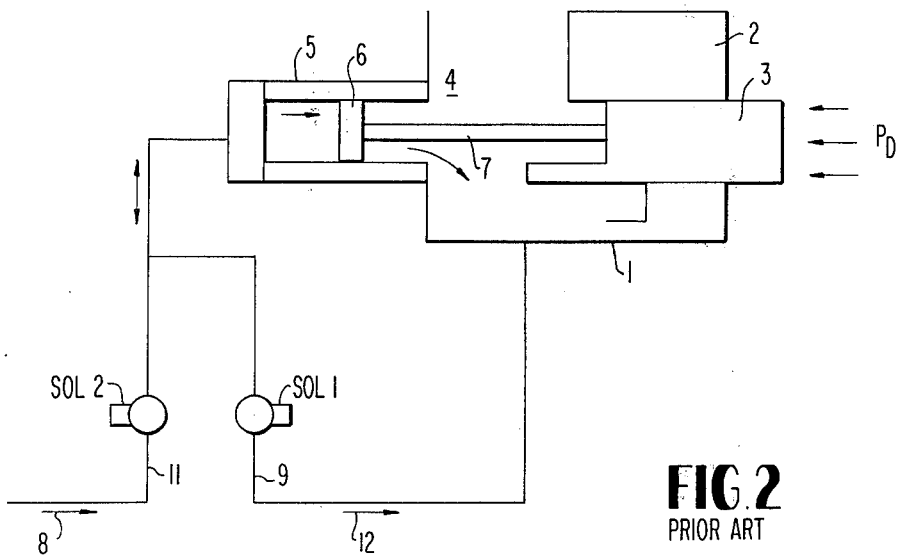
FIG. 2
PRIOR ART

FEEDBACK CONTROL SYSTEM FOR HELICAL SCREW ROTARY COMPRESSORS

BACKGROUND OF THE INVENTION

1. Field of the Invention

This invention relates to rotary helical screw compressors incorporating a slide valve for controlling compressor capacity, and more particularly to a slide valve feedback control system which is responsive to compressor discharge or line pressure.

2. Description of the Prior Art

In a helical, rotary screw compressor, the intermeshed helical screws acting in conjunction with the fixed compressor housing define the compressor working chamber in terms of closed threads, and the compressor operates as a positive displacement machine for compressing air, or a gas such as a refrigerant between the suction and discharge sides of the screw compressor. The match compressor load during compressor operation, the capacity of the helical, rotary screw compressor has been varied by incorporating a capacity control slide valve within the housing and slidable parallel to the axis of the screws. The slide valve shifts longitudinally between limits to control the percentage of the working fluid which is passed from the inlet or suction side to the discharge side of the machine. Conventionally, with the slide valve in closed position and against a valve stop, the compressor is fully loaded, in which case all of the working fluid flows from the intake to the discharge side. Unloading is achieved by moving the slide valve away from the valve stop to create a bypass which returns a portion of the suction gas to the inlet port area prior to compression of the same. Enlarging of the opening in the rotor housing by shifting of the valve longitudinally reduces the compressor displacement.

Screw compressors with slide valve unloading encounter load response problems based on system demand, because of:

(1) the inherently high and somewhat variable friction forces opposing slide valve movement;

(2) overshooting of the slide valve if slide valve actuation is fast because of the time lag in system pressure changes when demand and capacity are varied, resulting in the compressor continuously excessively hunting; and (3) nonresponsiveness of the slide valve to quick changes in demand, if slide valve actuation is slowed down in an attempt to reduce hunting.

Screw compressors with slide valve unloading have a propoportional power reduction with reduction in load but have a power input of about forty-five to fifty-five percent of full load power when operated at minimum load conditions for extended periods of time, in such systems where the working fluid which may be air or other gas, is discharging into a gas storage tank which is maintained at a given pressure. This invention will be described in conjunction with an air compressor system, wherein the compressor functions to maintain a given pressure to air stored within a tank for delivery to a load dependent upon load demand.

FIG. 1 constitutes a graphical illustration or plot of power against load for an air compressor operating to maintain 100 to 110 psi tank pressure in a pressurized air system with the power requirement for a conventional screw compressor system given by the solid line A for varying compressor load. With the compressor acting against a tank pressure of 100 psi, at zero load, the power requirements of the compressor are approximately fifty percent of full load. The present invention aims at reducing power requirements at minimum load as illustrated by the dotted line B of the plot which intersects the solid line A at a point approximating ten percent of compressor load and with the system operating otherwise identical between load conditions of ten percent to one hundred percent.

Reference to FIG. 2 shows the typical prior art compressor unloading arrangement for a helical screw rotary compressor operating within a typical refrigeration system. The compressor illustrated in FIG. 2 comprises schematically, a compressor casing 1 supporting intermeshed screws, one of which is shown at 2, and having a slide valve 3 movable longitudinally relative to the screws for controlling the return of a portion of the working fluid back to the suction side 4 of the machine. The position of the slide valve 3 is controlled by a hydraulic motor 5 incorporating a piston 6 which is directly connected to the slide valve 3 via rod 7. Oil under pressure, as indicated by arrow 8 acting through line 11, is applied to the outboard side or face of piston 6 to unload the compressor which overcomes the discharge gas pressure as indicated by arrows PD, acting on the discharge end of the side valve 3. When oil is bled from the outboard side of the piston 6, the pressure is reduced and the compressor slide valve 3 begins to load due to the discharge gas pressure force acting on the slide valve 3. Control of the slide valve is effected by means of solenoid valves $SOL_1$ and $SOL_2$ within line 11 open to the outboard side of piston 6 and line 9 leading to suction, respectively.

In a typical control system for such a helical screw compressor operating within a refrigeration or air conditioning system, a signal indicative of rise in suction pressure acts to open, normally closed solenoid valve $SOL_1$ in which case, oil drains from the outboard side of the piston in the direction of arrow 12 to conmpressor suction 4 and the compressor slide valve 3 shifts under the applied discharge gas pressure by way of arrows 10, the valve moving to the left towards load position. To the contrary, in response to compressor suction pressure drop, an appropriate circuit is completed to solenoid valve $SOL_2$, this valve delivering oil under pressure from a source, as per arrow 8, to the outboard side of the piston 6, forcing the slide valve 3 to move to the right against the discharge gas pressure PD and unloading the compressor.

In attempts to employ the unloading arrangement of FIG. 2 to an air compressor or similar application where discharge or system pressure is employed to activate solenoid valves $SOL_1$, and $SOL_2$, certain problems arise. The time lag in system pressure in reflecting the change in capacity will cause the slide valve to overshoot its desired position unless its actuation time is slowed down, which then results in the compressor capacity not responding fast enough to meet large and quick changes in system demand. Further, since the discharge gas pressure furnishes the loading force, start up with the slide valve in the zero load position is near impossible since the compressor never loads and there never is a force (indicated by arrows PD) acting on the discharge side of the slide valve in opposition to the applied oil pressure. Further, if not impossible, the system would take a long time to load, the system pressure being built up slowly with an unloaded compressor.

Once built up, the system pressure could position the slide valve.

It is, therefore, an object of this invention to provide a system in which the unloading control is insensitive to high and variable slide valve friction. It is a further object of this invention to provide an improved slide valve unloading control system for a helical screw compressor which employs a mechanical feedback of the slide valve position compared with system demand requirements.

Where the rotary helical screw compressor to which the unload control system of the present invention is employed constitutes an air compressor and wherein compressed air is stored at a given pressure for load application, it is a further object of this invention to provide the system with means for dumping the tank when the compressor is operating at minimum load such that the compressor continues on the line, but operates close to zero psi discharge pressure to reduce the minimum load horse power requirements to less than ten percent of that of full load.

SUMMARY OF THE INVENTION

The present invention is directed to a compressed air system which employs a helical screw, rotary compressor for providing compressed air for the system supply line with the compressor including a slide valve which shifts relative to the helical screws for varying compressor capacity. A drive motor shifts the slide valve to match compressor output to system demand and control means responsive to system demand controls the application of power from a power source to the drive motor. The improvement comprises feedback means responsive to slide valve movement and position for modulating the power controlling means to eliminate hunting of the slide valve.

Preferably, the compressor drive motor comprises a first linear fluid motor, the means responsive to system demand comprises a second linear fluid motor with the system gas from the system supply line being supplied directly to the second linear fluid motor to position the power controlling means for the first linear fluid motor. The system preferably comprises a compressed air system. The second linear motor comprises an air motor including a piston slidable within a cylinder and forming with the cylinder chambers on each side thereof with one of the chambers subjected to system line pressure which varies with system demand and the other being subjected to air at a fixed pressure which is normally lower than line pressure. The first linear motor comprises a hydraulic motor directly driving the slide valve and including a piston sliding within a cylinder and defining with said cylinder chambers on each side thereof and the power source comprises oil under pressure.

In one form, a valve spool slidably carried within the hydraulic motor piston controls the flow of oil under pressure to and from the inboard chamber on the one side of the first linear motor piston to effect a net driving force which acts on the hydraulic motor piston to position the slide valve. The system further includes means for mechanically coupling the second linear motor piston to the valve spool to cause the valve spool to shift relative to the motor piston. Movement of hydraulic motor piston acts as the feedback to the shifted valve spool.

The valve spool and the hydraulic motor piston may comprise first fluid passage means for causing the oil to flow from the first chamber to the second chamber, but not vice versa, when the valve spool is in a first position, and second fluid passage means for causing the oil to flow from the second chamber to the compressor suction when the valve spool is in a second position to thereby effect shifting of said slide valve to unload position. The valve spool is spring biased to the first position.

The system may further comprise a sequencing valve, fluid coupled to the source of pressurized oil and controlling the flow of pressurized oil to the first linear motor for insuring that the hydraulic piston moves during compressor start up in a direction to shift the slide valve towards compressor load position, and for placing the first linear motor under control of the second linear motor in response to system line pressure reaching a predetermined minimum value.

A gas storage tank is preferably fluid connected to the discharge side of the compressor and the supply line leads from the storage tank to supply compressor discharge gas to the system. A check valve is provided within the system line to prevent gas from flowing from the supply line back into the tank, and the tank further comprises a dump line leading from the tank to the atmosphere, a normally open solenoid operated dump valve within the dump line, a source of power for operating the solenoid operated dump valve, and a normally closed pressure responsive switch connecting the solenoid operated valve to the power source and responsive to system pressure whereby a rise in system pressure above a set point causes the contents to open and de-energizes the solenoid operated dump valve to dump the tank and prevent the compressor from acting against the tank pressure under zero and near zero load conditions. Further, shut down of the compressor automatically dumps the tank. Also connected to this pressure switch is a solenoid in the $P_{SR}$ line. When the contacts of the pressure switch open, the solenoid valve de-energizes and stops air flow to an air regulator. $P_{SR}$ drops as air flows out of bleed. With $P_{SR}$ low, the second motor is held in the unload position. This is to insure compressor stays unloaded during dumped tank operation.

In an alternative embodiment of the invention, first and second solenoid operated valve means selectively direct oil under pressure to respective sides of the first linear motor piston, or permit draining of oil under pressure from a given side of said first linear motor piston to the suction side of the compressor. An air motor responsive to system line pressure provides one input to a demand-capacity comparator for comparing the position of the screw compressor slide valve with that of the second linear motor piston for controlling the energization of said first and second solenoid operated valves. A system demand rod is fixed to the piston of said second linear motor and movable in response to system line pressure and a compressor capacity signal rod is fixed to the hydraulic piston and movable therewith parallel to the system demand rod as a capacity signal input. A cross shaped bracket has an upper vertical arm pivotably coupled to one end of the system demand rod and a lower vertical arm pivotably coupled at one end to the capacity signal rod and the bracket includes horizontal arms to each side thereof which support respectively, oppositely inclined mercury switches with said switches coupled to a source of electrical energy and respectively to said first and second solenoid operated valve means, whereby dependent upon the relative position of the air motor piston and the hydraulic motor piston, oil under pressure is supplied either to the first or second chamber of said hydraulic motor to move the slide valve towards load or unload position with the capacity signal rod acting to provide a mechanical feedback signal responsive to slide valve position.

BRIEF DESCRIPTION OF THE DRAWINGS

FIG. 1 is a plot of power requirements versus load for a typical helical screw, rotary air compressor with a slide valve unloading.

FIG. 2 is a schematic representation of a helical screw, rotary compressor employed in a typical refrigeration system with a conventional slide valve capacity control system.

DESCRIPTION OF THE PREFERRED EMBODIMENT

Figure 3:
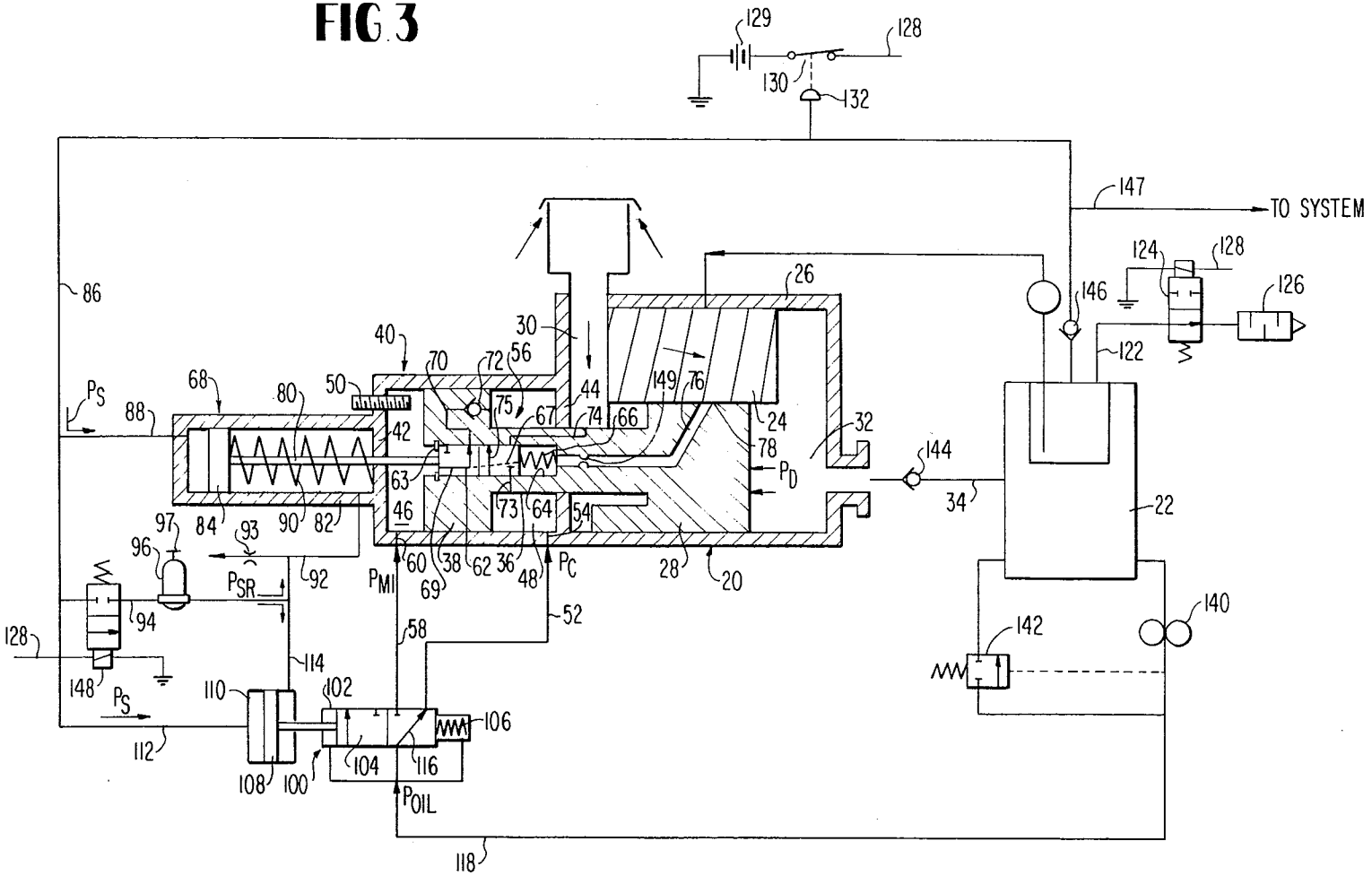
FIG. 3 is a schematic representation of a helical screw, rotary compressor for a compressed air system employing the improved slide valve capacity control system with feedback of the present invention in one form.

The present invention is illustrated in conjunction with a helical screw rotary compressor indicated generally at 20 which acts as an air compressor for maintaining compressed air at a pressure of between 100 and 110 psig within a combined compressed air storage tank and oil separator 22 and air system line 147. The screw compressor 20 includes a pair of intermeshed, rotary helical screws of which screw 24 is shown as mounted for rotation about a horizontal axis within compressor housing or casing 26, the intermeshed screws acting in conjunction with the housing slide valve 28 to compress air entering suction manifold 30 and discharged through discharge manifold 32 to discharge line 34 and thence to storage tank 22. The slide valve 28 is mounted for sliding movement within casing 26 in a longitudinal direction parallel to the axis of rotation of the screws, the slide valve 28 including an integral operating shaft 36 terminating in a hydraulic piston 38 which forms the moving component of a hydraulic motor 40. The screw compressor is represented schematically and the casing 26 defines in conjunction with the end walls 42 and 44 of the hydraulic motor, outboard and inboard chambers 46 and 48 for the piston 38 such that the application and removal of fluid pressure to respective chambers causes the piston to move to the right to unload the screw compressor or to the left to load the screw compressor. An adjustable slide valve stop 50 controls the extent of movement of the slide valve towards its full load position. The hydraulic piston 38 has acting thereon oil at pressure $P_c$ by way of line 52 and portion 54 within casing 26 within the inboard chamber 48 on the inboard side of the piston, or via spool 62 as explained below, while oil at the main injection pressure $P_{MI}$ acts within chamber 46 on the outboard side of the piston 38. The net force moves the slide valve 28 controlled by the spindle assembly indicated generally at 56. Oil at pressure $P_{MI}$ enters chamber 46 through line 58 and port 60. The spindle assembly 56 which transmits the force produced by the hydraulic piston to the slide valve 28 is provided with integral oil ports arranged in such a manner that whenever a hydraulic valve spool 62 is moved in relation to the spindle assembly 56 the control pressure $P_c$ increases or decreases to cause the spindle assembly 56 to move to a position so as to realign itself with the spool 62.

The hydraulic spool 62 comprises a cylindrical spool valve member which is slidably carried within bore 64 of the spindle assembly 56, the spool 62 being spring biased by way of valve spring 66 to the left, while the spool 62 is driven to the right by air cylinder assembly indicated generally at 68. The control of the oil pressure $P_c$ between $P_c$ high and $P_c$ low by the hydraulic spool 62 occurs as follows. The main injection oil at pressure $P_{MI}$ enters from line 58 and port 60 into chamber 46 and passes by way of passage 69 within the hydraulic spool 62 and passage 70 within the hydraulic piston 38 of the spindle assembly 56 and check valve 72 to chamber 48 on the inboard side of the piston 38 ($P_c$ high), when the spool is in the position shown in FIG. 3. Under system operation, when the air cylinder assembly 68 shifts the spool 62 to the right against the bias of compression spring 66, chamber 48 in the inboard side of the piston sees compressor suction pressure through passages 73 and 74 within spindle assembly 56 and passage 75 within the valve spool 62, which are fluid coupled at that moment ($P_c$ low).

Further, the hydraulic spool 62 being hollow permits oil under pressure $P_{MI}$ to flow through passage 69 and the axial passage indicated by dotted line 67 and oil injection passage 76 to injection port 78 for oil injection into the compressor closed threads for compressor cooling, lubrication and sealing purposes with oil quantity being controlled via orifice 149. As mentioned previously, the hydraulic spool 62 is spring loaded to the left by way of compression spring 66 within bore 64 and is shifted to the right by push rod 80 of air cylinder assembly 68.

In this regard, the air cylinder assembly 68 constitutes a linear air motor comprising cylinder 82 housing a reciprocating piston 84 attached to one end of push rod 80. The low friction seal and reciprocating piston 84 is air actuated by the system line or supply pressure $P_S$ of supply line 86 and tap line 88 leading to the outboard face of piston 84. A reduced air pressure acts on the other side or inboard face of piston 84. A compression spring 90 of relatively low spring rate biases the piston 84 to the left such that low pressure differential (throttle range) causes full stroke actuation of piston 84 and the hydraulic spool 62. Opposing the system pressure $P_S$ on the outboard side of piston 84, is adjustable reduced air pressure $P_{SR}$ through line 92 and line 94 leading to the supply line 86, line 94 including an air pressure regulation valve 96 therein for maintaining the reduced air pressure $P_{SR}$ at a set value for actuation on piston 84 of the air cylinder assembly 68, and a normally closed solenoid valve 148 therein for insuring compressor stays unloaded during dumped tank operation. Bleed 93 for 92 permits the air pressure in line 92 to reduce to zero upon closure of valve 148 also allows air out of $P_{SR}$ side when piston moves.

In addition to air cylinder 68, the system further comprises a sequencing valve assembly indicated generally at 100 which comprises a valve casing 102, housing a slidable spring loaded sequencing valve spool 104. A coil spring 106 biases the sequencing spool to the left and an air piston 108 of air cylinder assembly 110 moves the sequencing valve spool 104 to the right whenever the supply pressure $P_S$ is above a certain predetermined value. Line 112 connects the supply line 86 to air cylinder assembly 110, such that the supply pressure acts on the outboard side of the air piston 108. Line 114 fluid connects the inboard side of the air piston 108 to the air pressure regulation valve 96 such that that side of the piston 108 is subjected to air pressure at a value $P_{SR}$ which is the adjustably reduced air pressure identical to that within line 92. The sequencing valve assembly 100 has its spool 104 provided with an oil passage 116 such that whenever $P_S$ is below a certain predetermined pressure, (for example, at start up), oil pressure from line 118 at $P_{oil}$ is fed to the inboard side of the hydraulic piston 38, that is, to chamber 48, and shuts off oil supply to line 58, a combination which will load up the compressor by moving slide valve 28 to the left without the necessity of compressor discharge air pressure acting on the right side of slide valve 28. However, when the supply pressure $P_S$ reaches a certain predetermined pressure, the pressure differential acting between the inboard and outboard sides of the air piston 108 shifts the sequencing valve spool 104 to the right terminating the connection between lines 118 and 52 and shutting off oil pressure to port 54, which has the effect of turning over the control function of the unload valve 28 automatically to the air cylinder assembly 68 and hydraulic spool 62.

The system further comprises an air tank dump mechanism which includes a tank dump line 122 which includes dump valve 124 as a control element therein and muffler 126. The dump valve 124 is solenoid operated and controlled through line 128 which includes a normally closed switch 130 which is pressure operated by means of sensor 132 which senses the system pressure $P_S$ within line 86. Thus, upon $P_S$ exceeding set pressure, the pressure switch 130, which is normally closed, opens upon pressure to de-energize solenoid valve 124 to vent the tank 22 to atmosphere through muffler 126. Muffler 126 controls the noise produced when tank is dumped. Also, open switch 130 de-energizes solenoid 148 which allows $P_{SR}$ to vent down to atmospheric pressure.

An adjustable slide valve stop 50 operates to prevent motor overload when operating at a system pressure above, that is, may prevent movement of the slide valve to full load position.

The system is provided with an oil pump 140 for maintaining oil pressure at a value $P_{oil}$ within line 118 during operation of the compressor, the pressure being prevented from exceeding a predetermined level by the employment of an oil line pressure relief valve 142 which operates in a conventional manner. Various check valves are provided in the system such as at 144 in discharge line 34 to prevent reverse flow of compressed air from the storage tank 22 back to the compressor discharge manifold 32, and as at 146 to maintain pressure within supply line 86.

The operation of the control system of the present invention in the embodiment of FIG. 3 is as follows. Assuming that system requirements are such that normal tank pressure $P_D$ and system pressure $P_S$ within line 34 and tank 22 and line 86, respectively, is 100 psig, the system of the present invention is easily adjustable to operate at system pressure $P_S$ within the range of 85 to 125 psig. Assuming that the permissible throttle range is 10 psi, tank and system pressure would then range from 100 psig at full load to 110 psig at minimum load. It is desired that the compressor load up immediately upon start up and adjust its capacity immediately to system demand. When the compressor is operating at minimum load and line pressure $P_S$ has built up to a set pressure due to lack of system demand, tank air is dumped by way of dump valve 124 so that the compressor $\Delta$ P is reduced to near zero psi. Upon line pressure $P_S$ dropping below a certain level, the compressor is thus required to load up. When the compressor starts up, with the slide valve fully unloaded, that is, shifted to the right, the compressor and oil pump start, and the oil pump develops line oil pressure at a value $P_{oil}$. However, the air system pressure $P_S$, the tank pressure $P_D$, and the reduced air pressure $P_{SR}$ are all zero psig. With respect to the air cylinder assembly 68, the piston 84 is spring biased to the left and hydraulic spool 62 is moved to the left and against stop 63, FIG. 3. With discharge and tank pressure $P_D$ equal to zero psi and $P_C$ equal to $P_{MI}$ via sequencing hydraulic spool 62, the net force unloads the compressor. However, with the sequencing valve spool 104 spring loaded by way of compression spring 106 to the left, port 54 and line 52 are connected to line 118 at oil pressure $P_{oil}$. Oil flows to the inboard side of piston 38, into the inboard chamber 48 of the hydraulic motor 40. Check valve 72 prevents oil from flowing out to the outboard chamber 46 of the hydraulic motor 40. With the oil pump feeding oil into the inboard side of the piston, the net force produced causes the hydraulic piston 38 of the spindle assembly 56 and the slide valve 28 to move towards the left to full load position.

With the compressor fully loaded, air is pumped into the air tank and line pressure $P_S$ and discharge pressure $P_D$ (tank pressure) start to rise.

As line pressure $P_S$ rises, air pressure $P_{SR}$ also rises. However, no effect is felt on either air cylinder assembly 68, or air cylinder assembly 110 associated with the sequencing valve assembly 100. Pressure $P_{SR}$ continues to rise along with line pressure $P_S$ until the set point of the air regulator 96 is reached. At that point, air pressure $P_{SR}$ downstream of the pressure regulator 96 remains constant regardless of further increase in the supply pressure $P_S$ within line 86. Assuming that the air pressure regulator is set to maintain a pressure $P_{SR}$ of 85 psig, the supply pressure $P_S$ continues to rise above that value. At this point, a net force is produced on both piston 108 of air motor 110 and piston 84 of air cylinder assembly 68 to shift the same. These net forces are directed towards the right and opposed by springs 106 and 90 respectively. At some line pressure value, such as $P_S = 95$ psig, the net force produced on air cylinder air piston 108 overcomes the biasing force of spring 106 behind the spool 104, and the spool 104 shifts to the right. This shifts the connection of the oil line 118 at pressure $P_{oil}$ from line 52 to line 58 providing injection oil at pressure level $P_{MI}$ to chamber 46 which turns over the control function of the system to the air cylinder assembly 68 and hydraulic spool 62. The net force produced by line pressure $P_S$ and reduced air pressure $P_{SR}$ on air cylinder 68 is still smaller than that produced by the springs 90 and 66. With the air cylinder piston 84 and the hydraulic spool 62 to the left, oil pressure at pressure $P_{MI}$ flows through the spool and spindle ports through the passage 67, spindle passage 70 and check valve 72, thereby equalizing oil pressure on both sides of hydraulic piston 38, that is, within chambers 46 and 48. Note that the discharge pressure of the compressed air $P_D$ which acts on the right side of slide valve 28, produces a net loading force. The compressor stays loaded and line pressure $P_S$ continues to increase.

As noted previously, the normal operating range for the system in the example provided is between 100 and 110 psig $P_S$. As the line pressure $P_S$ reaches 100 psig with reduced line pressure $P_{SR}$ still at 85 psig, the net force on the air piston 84 in air cylinder assembly 68 now balances the combined spring force of springs 66 and 90. Any further increase in line pressure $P_S$ will cause the air piston 84 to move to the right compressing the spring 90 and in turn shifting hydraulic spool 62.

If demand is still less than 100 percent of compressor capacity, the line pressure $P_S$ will continue to rise. The air cylinder piston 84 moves a small distance to the right, based on line pressure $P_S$ increase above 100 psi and the spring rate of the spring 90. With the spool 62 shifting to the right in relation to the spindle assembly 56, passage 69 moves out of alignment with passage 70 within the spindle assembly piston 38, and the inboard side of the piston as defined by chamber 48 is closed off to oil pressure via lines 118 and 52 and port 54. Meanwhile, passage 73 within the spindle is coupled with passage 75 of spool 62 and passage 74 which causes chamber 48 to the inboard side of the piston 38 to open to the suction manifold 30. Oil flows out of the chamber 48 and chamber pressure $P_C$ drops until the net force (pressure $P_{MI}$ on the outboard side of the piston overcomes $P_C$ on the inboard side plus $P_D$ acting on the right hand side of the slide valve 28) causes the slide valve 28, the spindle assembly 56 and piston 38 to shift to the right. Thus, the piston 38 acts as a feedback to the spool of a signal representing capacity of the compressor. This movement will continue until the spindle assembly 56 has moved far enough such that the hydraulic spool 62 realigns the ports to the point where the forces acting on the slide valve assembly 28 are in equilibrium. In other words, changes in supply or line pressure $P_S$ (between 100 to 110 psi) cause movement of the air piston 84 which in turn shifts the hydraulic spool 62 which in turn causes oil to flow in a manner such that the hydraulic piston "tracks" movement of the air piston 84.

The spring arrangement of the spring 90 in the air cylinder assembly 68 is such that a 10 psi change in line pressure $P_S$ will cause full travel of the slide valve 28 between full load and no load positions and vice versa. Hence, as the system demand changes, line pressure $P_S$ will change ($P_S$ rising if demand is less than compressor capacity or dropping if demand is greater than compressor capacity). These changes in line pressure $P_S$ will cause the compressor to change its capacity to match the demand.

Under zero system demand, where the line pressure $P_S$ is greater than 110 psig and the compressor is still on the line, it is desirable that the compressed air within tank 22 be dumped, since this constitutes a load against which the compressor must act even though there is no system demand. During normal operating range where the line pressure $P_S$ is equal to 100 and 110 psig and the slide valve position changes from full load to complete unloaded position, even if fully unloaded the compressor still has some capacity, hence the rising line pressure $P_S$ acts on pressure sensor 132 of pressure switch 130. Upon reaching the set point, say 112 psig, the normally closed contacts automatically open. Opening of line 128 de-energizes both dump solenoid 124 and $P_{SR}$ solenoid 148. De-energized solenoid 148 allows $P_{SR}$ to drop by air bleed. This holds the compressor in the unloaded position. De-energizing of solenoid 124 allows the tank to blow down. System air does not flow back into the tank because of the check valve 146 which maintains line pressure $P_S$ at a given value, assuming there is no system demand. The tank 22 remains vented to the atmosphere until the line pressure $P_S$ decreases below 95 psig, due to system leakage or system demand. When the line pressure $P_S$ reduces below 95 psig, the contacts of the pressure switch close, energizing solenoid 124 which stops the dumping of the tank, and energizing solenoid 148 which allows the system air to flow through air regulator and re-establish $P_{SR}$. Once $P_{SR}$ is re-established and with $P_S$ being below the set point, sequencing valve spool 104 will shift over via spring 106 to the left, feeding oil within line 118 at pressue $P_{oil}$ to the chamber 48 via line 52. Oil from line 118 within chamber 48 on the inboard side of the hydraulic piston 38 shifts the slide valve to the left towards load position, and the compressor starts loading, and with the solenoid operated dump valve 124 de-energized, the dumping function ceases and the tank starts to pressurize.

The setting of system pressure is accomplished by three adjustments. They include the air regulator 96 which raises or lowers the reduced line pressure $P_{SR}$ acting on air cylinder assembly 68 and 110 in opposition to line pressure $P_S$, the position of the slide valve stop 50 which prevents motor overload when operating at a line pressure higher than design pressure and the setting of pressure switch 130. To raise the system pressure $P_S$ within discharge line 86, screwing in the handle 97 on the air pressure regulator valve 96 raises the pressure $P_{SR}$. This increases the bias pressure on both air cylinder assemblies 68 and 110. Therefore, it will take a higher line pressure $P_S$ before the sequencing valve 100 will shift over. The higher bias pressure on the air cylinder assembly 68 will require a higher line pressure $P_S$ before it starts to move the piston 84 to the right to cause the slide valve to move towards unload position. For example, assuming that pressure $P_{SR}$ is raised by 10 psi from 85 to 95 psig, this will cause shifting of the sequencing valve 110 at line pressure $P_S$ equal to 105 psig instead of 95 psig and changes the operating range of the air cylinder assembly 68 to line pressure equal to 110 psig at full load and 120 psig at full unload. With a motor size designed to handle full load at line pressure $P_S = 100$ psig, a motor overload would occur if the system were operated at full load at the higher line pressure $P_S$. Therefore, as the air regulator is adjusted to raise the pressure $P_{SR}$, the slide valve stop 50 should be screwed in a specified amount to prevent the compressor from loading fully. Otherwise, the motor may be burned out. The setting of pressure switch 130 must be raised to initiate the dump function at say $P_S = 122$.

Figure 4:
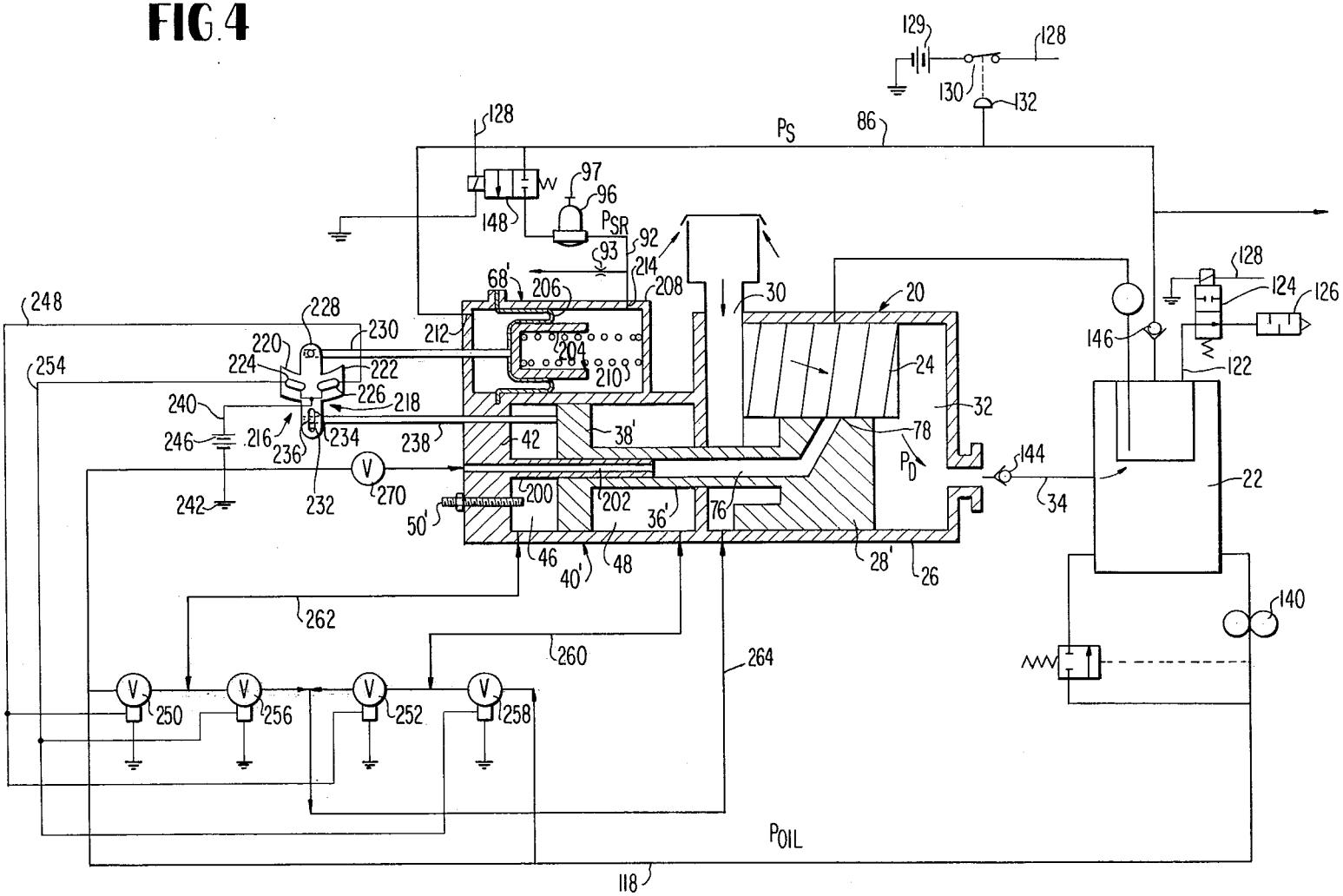
FIG. 4 is a schematic representation of a helical screw, rotary compressor for an air compressor system employing an alternate embodiment of the slide valve capacity control system with feedback of the present invention.

The second embodiment of the invention is illustrated in FIG. 4. Like elements are given like numerical designations to that of FIG. 3. The capacity slide valve feedback control system is employed in conjunction with a helical screw rotary compressor in similar fashion to the embodiment of FIG. 3, where air compressor 20 maintains compressed air at a preset line or supply pressure $P_S$ within a given range and acting in conjunction with a compressed air storage tank 22. In this regard, slide valve 28' slides within compressor casing 26 and is associated with a pair of intermeshed rotary helical screws such as screw 24 which compress air entering the inlet or suction manifold 30 as indicated by the arrow and is discharged into discharge manifold 32 and thence through check valve 144 and discharge line 34 to the storage tank 22. The discharge pressure is identified at $P_D$, and line pressure within line 86 is $P_S$. The hydraulic piston 38' acts as an integral extension of the slide valve 28 through a hollow connecting rod 36' which includes a passage 76, permitting the injection of oil into the intermeshed helical screws, via port 78 in the manner of the first embodiment. The end wall 42 includes a tubular extension 200 which acts in conjunction with passage 202 as a telescoping connection to permit oil under pressure to be injected into the intermeshed screws via injection port 78 located within the slide valve 28'. The position of the hydraulic piston 38' of hydraulic motor 40' and thus the slide valve 28' is controlled by air cylinder assembly 68'. Inboard and outboard chambers are formed at 48 and 46 respectively on opposite sides of hydraulic piston 38' and the net force acting thereon moves the slide valve 28' via spindle or connecting rod 36' between a full unload position to the right and a full load position to the left, wherein the piston 38' abuts the adjustable slide valve positioning rod 50' in similar manner to the prior embodiment.

The air cylinder assembly 68' in this case consists of a low friction, air actuated and spring return piston 204 which is mounted by way of diaphragm 206 for movement within cylinder 208, a helical coil spring 210 biasing the piston 204 to the left. The system or line pressure $P_S$ within line 86 acts through port 212 on the left side of piston 204, while the reduced air pressure $P_{SR}$ acts on the right side via line 92, the air pressure regulation valve 96, and port 214. The coil spring 210 has a relatively low spring rate such that a small change in line pressure $P_S$ within the throttle range will cause full travel of piston 204.

This embodiment of the invention includes a demand capacity comparer indicated generally at 216 which comprises a modified cross shaped bracket 218 including horizontal arms 220 and 222 which support oppositely inclined mercury switches 224 and 226. The upper vertical arm 228 is pivotably coupled to the outboard end of an air cylinder push rod 230 whose inboard end is fixed to piston 204 of air cylinder assembly 68'. An elongated vertical slot 232 is formed within the lower vertical arm 234 of bracket 218, and the slot 232 receives a pivot pin 236 which is fixed to and extends at right angles from a horizontal capacity signal rod or slide valve position rod 238 whose inboard end is fixed to the hydraulic piston 38' forming an integral part of the slide valve 28'. Due to the pivot connections at respective arms 228 and 234 for rods 230 and 238, the relative movement between rods 230 and 238 cuases the bracket 218 to tilt either clockwise or counterclockwise. If the bracket is tilted clockwise, a compressor unload signal is produced, and if tilted counterclockwise, a compressor load signal is produced. No signal is given if the bracket is vertical, since the slightly inclined mercury switches have their mercury concentrated in the bottom of the switches and will not bridge the spaced contacts of the mercury switches. The mercury switches are quite conventional, they consist essentially of hollow tubes carrying conductive liquid mercury and having spaced fixed contacts which when the longitudinal axis of the tube is horizontal, permits the mercury to span the gap between the contacts and complete an electrical circuit therebetween. In this respect, line 240 which is grounded at 242 carries a source of electrical power such as battery 246 and is commonly connected to the inboard contacts of both mercury switches 224 and 226. The outboard contact of right hand mercury switch 226 is connected via line 248 to unload solenoid valves 250 and 252 which are grounded to return. In similar fashion, left hand mercury switch 224 is connected by its outboard contact, and line 254 to load solenoid valves 256 and 258. Solenoid valves 250, 252, 256 and 258 control the application of oil under pressure within the line 118 by operation of oil pump 140 to inboard chamber 48 via line 260, outboard hydraulic motor chamber 46 via line 262, and permit these chambers to be connected to the suction manifold 30 of the compressor via line 264 in a manner to be described more fully hereinafter.

As mentioned previously, the bracket 218 is attached to the air cylinder push rod 230 and the slide valve position rod 238 such that the relative positions of these two rods cause the bracket 218 to tilt either way or to hang vertically. Since the inclination of the bracket controls the energization of the various solenoids, the solenoids are arranged in a manner such that the unload solenoid valve pair 250 and 252 permit oil under pressure from line 118 to enter chamber 46 on the outboard side of the hydraulic piston 38' and let the oil within chamber 48 on the inboard side of the same piston escape to suction via line 264, respectively. The pair of load solenoid valves 256 and 258 permit oil to pass from the outboard side of the piston to suction via line 264 and permit oil under pressure from line 118 to enter chamber 48 on the inboard side of the piston 38', respectively. Valve 270 within line 118 controls the flow of pressurized oil to injection port 78 for the slide valve 28', which forms no part of the present invention.

The air tank dump mechanism is the same as the embodiment of FIG. 3. A pressure switch 130 which senses the air pressure within the supply line 86 is provided with normally closed switch contacts. Contacts open upon a pressure rise within line 86. This both de-energizes solenoid valve 124 via line 128 to dump the tank 22, thereby venting the tank via line 122 to atmosphere via the muffler 126 which slowly reduces the pressure within the tank and de-energizes solenoid 148 via line 128 which allows $P_{SR}$ to drop by air bleed thereby holding air piston 204 in the unload position to inhibit the compressor from loading up during the dump cycle and prevent energization of the load solenoid valves 256 and 258. Again, the adjustable slide valve stop 50' prevents motor overload when operating at a system pressure above design pressure, since it prevents the slide valve 28' from moving to full load position under such circumstances. Of course, this requires that the stop be projected inward from wall 42 when operating by system above design pressure from that which would normally permit the slide valve 28' to move to full load position.

In the operation of this embodiment, start up occurs with the slide valve 28' in the unload position as shown in FIG. 4. The compressor 20 and oil pump 140 start with the oil pump developing an oil pressure $P_{oil}$ within line 118. However, the air system pressure $P_S$, tank pressure $P_D$, and reduced pressure $P_{SR}$, are all at zero psig. The air cylinder piston 204 and push rod 230 are spring loaded to the left causing demand-capacity comparator to tilt counterclockwise producing a load signal. The load signal energizes the solenoid valves 256 and 258 which feed oil to the inboard side of the piston 38', that is, within chamber 48, and lets oil out of the outboard chamber 46 for return to suction via line 264. This causes the slide valve 28' to move towards the left thus loading the compressor. This will continue until the slide valve 28' shifts push rod 238 to the left to the extent that it returns the comparator 216 (bracket 218) to the vertical position, at which time the load signal ceases. Rod 238 acts as the feedback signal to the comparator representing compressor capacity. Mercury switch 224 being open, the solenoid valves 256 and 258 de-energize and slide valve movement ceases. With the compressor fully loaded, air is pumped into the air tank at discharge pressure $P_D$; line pressure $P_S$ and reduced pressure $P_{SR}$ start to rise. With both line pressure $P_S$ and reduced pressure $P_{SR}$ rising equally, no net force is produced on the piston of the air cylinder and the rod 230 remains in the same position.

Assuming that the normal operating range is one in which the pressure $P_S$ is between 100 and 110 psig, as line pressure $P_S$ continues to rise, pressure $P_{SR}$ also rises until the set point of the air pressure regulator valve 96 is reached, at which time reduced pressure $P_{SR}$ stays constant, for instance, at 95 psig. As line pressure $P_S$ continues to rise and that force is applied to the air piston 204 of air cylinder assembly 68' to oppose the spring 210, the increasing line pressure $P_S$ acts on the left side of piston 204 and against the spring. When line pressure $P_S$ reaches 100 psig, the force produced exactly balances the spring force and that of $P_{SR}$. Any further increase of line pressure $P_S$ (due to compressor capacity being larger than demand) will cause the air cylinder piston 204 to move to the right compressing the spring 210 a certain amount. This will tilt the demand-capacity comparator bracket 218 clockwise, which produces an unload signal. This energizes the solenoid valves 250 and 252 which permits oil to flow via solenoid valve 250 and line 262 to chamber 46 while at the same time oil within chamber 48 drains through line 260, solenoid valve 252 and line 264 to the suction side of the compressor. The compressor 20 will unload by way of soelnoid valves 250 and 252 only to the extent that the comparator bracket 218 moves to vertical, upright position. In other words, any mismatch between demand and capacity will cause system pressures to change, and this change will cause the air cylinder piston to move. The compressor slide valve will move to "track" the air cylinder by way of the comparator 216 and its solenoid operated valve in such a manner that compressor capacity will be changed to match system demand with feedback emanating from rod 238.

With zero system demand and the compressor still on the line, it is desirable that the air tank 22 be dumped. If system demand is zero, then line pressure $P_S$ will continue to climb above 110 psig, even through the compressor is completely unloaded because even through fully unloaded, the compressor still has some capacity. As the line pressure $P_S$ reaches 112 psig, for instance, then the pressure switch 130 is actuated and the normally closed switch contacts in line 128 open to de-energize the solenoid operated dump valve 124 via an electric power source 129 such that the tank dumps through line 122, valve 124 and muffler 126 to the atmosphere. Meanwhile, check valve 146 prevents this system from dumping line pressure within line 86 and system air does not flow back into the tank due to the presence of that check valve within line 86.

When the pressure switch 130 is actuated, it also de-energizes solenoid valve 148 which allows $P_{SR}$ to drop via air bleeding out via air bleed. This prevents short cycling. Without this arrangement in the $P_{SR}$ line, the compressor would start loading when line pressure $P_S$ dropped to less than 110 psig, since air cylinder would start to move to the left. But with $P_{SR}$ dropped, the air cylinder will stay in the right hand or unload position, thereby keeping the compressor unloaded, until the pressure differential of switch 130 reaches a predetermined value such as 10 psig or a line pressure $P_S$ of 102 psig.

The setting of the system pressure $P_S$ is accomplished by three adjustments. The first adjustment is to air regulator 96 which raises or lowers the reduced line pressure $P_{SR}$. The second adjustment is made to the valve stop 50' which prevents motor overload when operating at a line pressure $P_S$ higher than the design pressure and the third is to the pressure switch 130 which dumps the tank 22 at a certain line pressure $P_S$. To raise the system pressure, or line pressure $P_S$, the handle 97 on the air pressure regulating valve 96 is screwed in, which raises reduced pressure $P_{SR}$ within line 92 downstream of the valve 96. This increases the bias pressure on the air cylinder assembly 68'. The higher bias pressure on the air cylinder assembly requires a higher line pressure $P_S$ before it starts to move. For example, say that $P_{SR}$ is raised by 10 psi from 85 to 95 psig. This will cause the operating range of the cylinder assembly to shift from $P_S = 110$ psig at full load to $P_S = 120$ psig at full unload. With a motor size designed to handle full load at $P_S = 100$ psig, a motor overload would occur if the system were operated at full load at the higher line pressure $P_S$. Therefore, as the air regulator is adjusted to raise or reduce line or system pressure $P_{SR}$, the slide valve stop 50' must be screwed in a specified amount to prevent the compressor from loading fully.

Finally, the pressure switch 130 must be adjusted in terms of its setting so that it dumps the tank at 122 psig instead of 112 psig.

While the invention has been particularly shown and described with reference to preferred embodiments thereof, it will be understood by those skilled in the art that the foregoing and other changes in form and details may be made therein without departing from the spirit and scope of the invention.

What is claimed is:

1. In a system for supplying a gas under pressure from a system supply line including a helical screw rotary compressor for compressing said gas from a low pressure at suction to a high pressure at discharge and connected to said line at compressor discharge and having a slide valve for varying compressor capacity by returning a portion of the gas to the suction side of said compressor prior to compression of the same, a first fluid motor for shifting said slide valve to match compressor output to system demand, a source of fluid under pressure, means responsive to system demand for controlling the flow of fluid under pressure from said source to said first fluid motor to effect shifting of said slide valve, and feedback means responsive to slide valve position for modulating said power controlling means to eliminate hunting of said slide valve, the improvement wherein, said power controlling means comprises means for controlling the flow of said fluid between said source and said first fluid motor, and wherein a second fluid motor operatively engages said power controlling means, said system including means for applying system gas from said supply line directly to said second fluid motor to drive said power controlling means in response to system gas pressure variation, said system further comprising a compressed air system, said second motor comprising a linear air motor including a piston slidable within a cylinder and forming with said cylinder, chambers on each side thereof, and said system further including means for subjecting one of said chambers to the system line pressure which varies with system demand, and means for supplying to said other chamber air at a fixed pressure which is normally lower than line pressure.

2. The system as claimed in claim 1, wherein said first motor comprises a linear hydraulic motor directly driving said slide valve including a piston sliding within a cylinder and defining with said cylinder first and second chambers on each side thereof, said source of fluid comprises oil under pressure, and said power controlling means includes a valve spool slidably carried by said hydraulic motor piston for controlling the flow of said oil to and from first and second chambers on respective sides of said first linear motor piston to effect a net driving force which acts on said hydraulic motor piston to position said slide valve, and said system further includes means mechanically coupling said second linear motor piston to said valve spool to cause said valve spool to shift relative to said motor piston to drive said slide valve and said feedback means comprises said motor piston which shifts relative to said valve spool.

3. The system as claimed in claim 2, wherein said valve spool and said hydraulic motor piston comprise first fluid passage means for causing said oil to flow from said first chamber to said second chamber but not vice versa when said valve spool is in a first position, and second fluid passage means for causing said oil to flow from said second chamber to compressor suction when said valve spool is in a second position to effect shifting of said slide valve to unload position.

4. The system as claimed in claim 3, further comprising a sequencing valve operatively fluid coupled between said pressurized oil source and said first linear motor for insuring that the slide valve moves during compressor start up towards compressor load position and for placing said first linear motor under control of said second linear motor in response to system supply line air pressure reaching a predetermined value.

5. The system as claimed in claim 4, wherein; said sequencing valve comprises a sequencing valve spool slidable between first and second positions, said sequencing valve spool includes a first passage means for fluid connecting said oil source to said second chamber of said first linear motor when said sequencing valve spool is in a first position, and second fluid passage means for causing said oil to flow to said first chamber of said first linear motor when said sequencing valve spool is in a second position, and said sequencing valve includes means normally maintaining said sequencing valve spool in said first position unless said system air pressure is above said predetermined minimum level.

6. The system as claimed in claim 5, further comprising: a second air motor operatively coupled to said sequencing valve spool and responsive to system line pressure for moving said sequencing valve spool from said first position to said second position.

7. The system as claimed in claim 6, wherein said means for supplying to said other chamber air at a fixed pressure which is normally lower than line pressure comprises an adjustable air pressure regulating valve for reducing air pressure to maintain an air pressure source at a normally fixed pressure value, below system pressure, and means for supplying said reduced air pressure to said first and second air motors in opposition to said system pressure to facilitate operation of said sequencing valve and said hydraulic valve spool within said first linear motor piston.

8. The system as claimed in claim 7, further comprising means for automatically reducing the pressure in said reduced air pressure supply means in response to system pressure rise to a predetermined level.

9. The system as claimed in claim 2, wherein: a gas storage tank is fluid connected to the discharge side of said compressor, said supply line leads from said storage tank to supply compressor discharge gas to said system, a check valve is provided within said system line to prevent said gas to flow from said supply line back into said tank, and said tank further comprises a dump line leading from said tank to the atmosphere, a solenoid operated dump valve within said dump line, a source of power for operating said solenoid operated dump valve, and a normally closed pressure responsive switch connecting the solenoid operated valve to said power source and responsive to system pressure; whereby, rise in system pressure above a set point opens normally closed contacts of said pressure switch and de-energizes said solenoid operated dump valve to prevent the compressor from acting against tank pressure under zero or near zero load conditions.

10. The system as claimed in claim 5, wherein: a gas storage tank is fluid connected to the discharge side of said compressor, said supply line leads from said storage tank to supply compressor discharge gas to said system, a check valve is provided within said system line to prevent said gas to flow from said supply line back into said tank, and said tank further comprises a dump line leading from said tank to the atmosphere, a solenoid operated dump valve within said dump line, a source of power for operating said solenoid operated dump valve, and a normally closed pressure responsive switch connecting the solenoid operated valve to said power source and responsive to system pressure; whereby, rise in system pressure above a set point opens normally closed contacts of said pressure switch and de-energizes said solenoid operated dump valve to prevent the compressor from acting against tank pressure under zero or near zero load conditions.

11. The system as claimed in claim 7, wherein: a gas storage tank is fluid connected to the discharge side of said compressor, said supply line leads from said storage tank to supply compressor discharge gas to said system, a check valve is provided within said system line to prevent said gas to flow from said supply line back into said tank, and said tank further comprises a dump line leading from said tank to the atmosphere, a solenoid operated dump valve within said dump line, a source of power for operating said solenoid operated dump valve, and a normally open pressure responsive switch connecting the solenoid operated valve to said power source and responsive to system pressure reaching a predetermined maximum pressure; whereby, rise in system pressure above a set point opens normally closed contacts of said pressure switch and de-energizes said solenoid operated dump valve to prevent the compressor from acting against tank pressure under zero or near zero load conditions.

12. The system as claimed in claim 11, further comprising a bleed means within said reduced air pressure supply means and valve means upstream of said bleed means responsive to system pressure reaching said predetermined maximum pressure for closing off said pressure source to said first and second linear air motors; whereby, the air bleeds from one side of said air motors at the time the air dumps.

13. The system as claimed in claim 11, further comprising adjustable stop means for said hydraulic motor to limit shifting of said slide valve toward load position to prevent full loading of said compressor when said air pressure regulating valve is set to maintain system pressure at a value which is too high for the capacity of compressor drive motor.

14. The compressed air system as claimed in claim 1, wherein said first linear motor comprises a hydraulic motor, said power source comprises oil under pressure, and said power controlling means comprises first solenoid operated valve means within lines leading respectively from said oil source to said hydraulic motor chambers and second solenoid operated valve means within lines leading from respective chambers of said hydraulic motor to the suction side of said compressor.

15. The compressed air system as claimed in claim 14, wherein said second linear motor comprises an air motor including a spring biased piston subjected on one side to system line pressure and on the other side to a biasing spring and normally fixed fluid pressure which is less than line pressure, and said feedback means further comprises a demand-capacity comparator for comparing the position of said slide valve with said second linear motor for controlling the energization of said first and second solenoid operated valve means.

16. The compressed air system as claimed in claim 15, wherein; a system demand rod is fixed to said piston of said air motor and movable therewith horizontally along a path parallel to the movement of said slide valve and said feedback means includes: a compressor capacity signal rod fixed to said hydraulic piston and movable therewith, parallel to said system demand rod, a cross-shaped bracket having an upper vertical arm pivotably coupled to one end of said system demand rod, and a lower vertical arm pivotably coupled to one end of said capacity signal rod, said bracket includes horizontal arms to each side thereof which support, respectively, oppositely inclined mercury switches having contacts within respective ends and a mass of mercury which bridges the contacts thereof only when said bracket is tilted to a position where a mercury switch has its axis horizontal, said system further includes a source of electrical energy and circuit means fluid connecting one of said mercury switches to said first solenoid operated valve means, and said other mercury switch to said second solenoid operated valve means; whereby, dependent upon the relative position of said air motor piston and said hydraulic motor piston, oil is supplied either to said first or second chamber of said hydraulic motor to move said slide valve towards load or unload position with said slide valve providing a mechanical feedback signal responsive to compressor capacity.

17. In a compressed air system for maintaining air within an air line at a given line pressure including: a helical screw rotary compressor coupled to said line for compressing said air from a low pressure at compressor suction to a high pressure at compressor discharge and including a slide valve for varying compressor capacity by returning a portion of the air to the suction side of the compressor prior to compression thereof, and a hydraulic motor including a piston slidable within a cylinder and forming with the cylinder, first and second chambers, said motor shifting said slide valve to load and unload said compressor, and means for removing a hydraulic liquid under pressure from said first chamber to move said slide valve to compressor unload position and to supply said hydraulic liquid under pressure to the same chamber for shifting said piston towards full load position, the improvement wherein said means for supplying said hydraulic fluid comprises;

a source of hydraulic liquid under pressure, a sequencing valve for supplying said hydraulic liquid to said first chamber at compressor start up to insure shifting of said slide valve towards said full load position and for supplying said hydraulic liquid to said other chamber after start up and upon line pressure reaching a predetermined minimum value, a valve spool slidably carried by said hydraulic motor piston and spring biased to a first position, said valve spool and said piston including first fluid passage means for fluid connecting said second chamber to said first chamber to permit hydraulic liquid to flow from said second chamber to said first chamber but not vice versa, and second fluid passage means for fluid coupling said first chamber to compressor suction, and an air cylinder motor including a piston slidable within a cylinder and subjected to line pressure on one side and mechanically coupled to said valve spool for shifting said valve spool from said first position to said second position, and being subjected on the other side to air pressure which is normally fixed relative to line pressure and at a value normally below that of said system line, to cause said valve spool to shift to a position where said slide valve unloads the compressor at a predetermined pressure differential across the piston of sid air motor.

18. The compressed air system as claimed in claim 17, wherein said air cylinder motor includes a coil spring acting on the same side of said piston as said reduced line pressure with the spring rate of said spring being such that said valve spool shifts between said first and second positions as the compressor changes from full load to full unload condition.

* * * * *